US005707467A

United States Patent [19]

Matsumaru et al.

[11] Patent Number: 5,707,467

[45] Date of Patent: Jan. 13, 1998

[54] STEEL CORDS, RADIAL TIRE REINFORCED WITH SAME, AND APPARATUS FOR PRODUCING SAME

[75] Inventors: Kazuo Matsumaru, Kitakami; Koichi Horikawa, Hanamaki, both of Japan

[73] Assignee: Tokyo Rope Manufacturing Co., Ltd., Tokyo, Japan

[21] Appl. No.: 522,311

[22] PCT Filed: Dec. 27, 1994

[86] PCT No.: PCT/JP94/02260

§ 371 Date: Oct. 18, 1995

§ 102(e) Date: Oct. 18, 1995

[87] PCT Pub. No.: WO95/18259

PCT Pub. Date: Jul. 6, 1995

[30] Foreign Application Priority Data

Dec. 27, 1993 [JP] Japan ..... 5-346981
May 27, 1994 [JP] Japan ..... 6-136655

[51] Int. Cl.[6] ..... B60C 9/00; B60C 9/18; B60C 9/20; D07B 1/06

[52] U.S. Cl. ..... 152/527; 57/206; 57/237; 57/311; 57/902; 152/451

[58] Field of Search ..... 152/451, 527; 57/200, 206, 902, 237, 311, 58.49, 58.52, 58.65

[56] References Cited

U.S. PATENT DOCUMENTS 5,287,691 2/1994 Okamoto et al. ..... 152/527 X
5,319,915 6/1994 Kobayashi et al. ..... 152/451 X
5,323,595 6/1994 Mizuta et al. ..... 257/902 X
5,337,549 8/1994 Kobayashi et al. ..... 57/902 X
5,351,470 10/1994 Shinmura ..... 57/311 X
5,457,949 10/1995 Bundo et al. ..... 57/902 X
5,472,033 12/1995 Kawamura et al. ..... 152/527
5,502,960 4/1996 Kobayashi et al. ..... 57/311 X

FOREIGN PATENT DOCUMENTS 1250483 10/1989 Japan .
2-68376 3/1990 Japan .
4-24296 1/1992 Japan .
5-279974 10/1993 Japan ..... 57/902

*Primary Examiner*—Adrienne C. Johnstone
*Attorney, Agent, or Firm*—Michael J. Striker

[57] ABSTRACT

A high elongation compact helical steel cord with a high degree of elongation at break of not less than 5% has a (1×n) structure comprising three or more base wires which are helically preformed at a predetermined pitch and which are twisted in the same direction and at the same pitch so that the ratio P/D of the cord diameter D to the twisting pitch P is in the range of 8–15 with the base wire preforming pitch being shorter than the cord twisting pitch. The finished cord has a helical composite structure with its elongation under a load of 35 kgf/mm$^2$ being 0.71%–1.00% and that under a load of 70 kgf/mm$^2$ being 1.18%–1.57%. A radial tire is reinforced with the steel cord preferably as a steel belt cord. An apparatus for making the steel cord is provided with revolving preformers on the wire introducing portion of a bunching machine such that the bunching machine is rotated in a direction reverse to the rotational direction of the revolving preformers.

9 Claims, 5 Drawing Sheets

STEEL CORDS, RADIAL TIRE REINFORCED WITH SAME, AND APPARATUS FOR PRODUCING SAME

BACKGROUND OF THE INVENTION

The present invention relates to rubber-reinforcing steel cords, particularly to one operation type high elongation steel cords and also relates to a radial tire using these steel cords as reinforcing members. The present invention also relates to an apparatus for manufacturing steel cords in accordance with the present invention.

In the case of the radial tire, reinforcing layers called belts are provided between the tread and the carcass and steel cords serving as composite reinforcing members are embedded in the reinforcing layers.

For such steel cords, there is a tendency to use high elongation cords having an improved anti-cutting property when, for example, the tire runs over a stone or the like.

The above-mentioned high elongation cords are generally classified into multi-stranded type represented by (3×7), (4×2) and (4×4) structures and one operation type represented by a (1×n) structure comprising 6 or less base wires. However, the multi-stranded type has the disadvantages that since it requires two or more twisting steps, the productivity thereof is low resulting in a cost increase and further, the weight of the belt layers increases due to increase in the number of twists and in view of these defects, the single operation type is generally more advantageous.

The conventional single operation type has had the structure such that for example, in the case of a (1×5) structure, five (5) base wires are twisted in the same direction and at a short pitch. That is, by twisting the base wires to a spring form a shortened twisting pitch, the core (central) portion of the cord is made hollow to thereby secure the elongation of the cord.

However, in order to obtain a high decree of elongation of 4% or more of the cutting load by this system, it is necessary to twist the base wires at an extremely shortened of 6.5 mm for example or to twist them by a multi-operation method as described in the Japanese Laid-Open Patent Publication No. H1-250483. Therefore, it has been usual that the productivity of the cords becomes low and becomes of the short twisting pitch, the twisting loss becomes large so that the efficiency of strength of the steel wires can not be made use of. Moreover, due to the formation of a rubber-impenetrable hollow portion at the center of the cord, the tread of the tire is damaged allowing water to enter into the hollow portion and to pool therein resulting in a corrosion fatigue of the steel cord or separating the cord from rubber against the adhesive strength of rubber.

As a rubber penetration measure, there is proposed in the Japanese Laid-Open Patent Publication H2-68376 and H4-24296 a high elongation steel cord which is twisted at a short pitch and at a slow speed so that gaps are formed among the steel wires.

However, this prior art technique has also had the problems of cost and the lowering of strength of the cord due to a twisting loss because the twisting pitch is short. Further, due to the instability of twisting structure, the gaps among the wires tend to change so that when an external force is applied in the longitudinal direction of the cord at the time of vulcanization of rubber, the gaps are reduced or biased. Therefore, the steel cord tends to get fatigued or fractured due to the stress concentration at the time when the steel cord is buckled. Further, as the wires are twisted loosely to provide large gaps among the wires, when the tire runs over a nail or a metallic strip, it is liable to penetrate into the cord resulting in lowering its external injury-resistant property.

SUMMARY OF THE INVENTION

The present invention has been made to eliminate the above-described problems and accordingly, a first object of the present invention is to provide a compact high elongation steel cord capable of a large elongation at the time of breakage, having a small twisting loss and a favorable degree of rubber penetration yet capable of being manufactured simply and efficiently by one twisting operation.

A second object of the present invention is to provide a radial tire which is reinforced with the above-mentioned high elongation steel cord giving rise to a high anti-cutting property and a sense of comfortable driving and with which the phenomenon of cord separation hardly takes place.

In order to achieve the first object of the invention the steel cord according to the present invention has a (1×n) structure comprising three or more base wires twisted by one operation in the same direction and at the same pitch and having an elongation at break of not less than 5%. The steel cord has a helical composite structure formed such that three or more base wires subjected to a helical preform at a pitch shorter than the twisting pitch of the cord are twisted so that the ratio P/D of the cord outer diameter D to the twisting pitch P falls under the range of 8–15 and the rate of elongation under a load of 35 kg f/mm$^2$ is in the range of 0.71–1.00% while the rate of elongation under a load of 70 kg f/mm$^2$ is in the range of 1.18–1.57%.

Preferably, each of the base wires with a helical preform has a preforming pitch L of $0.25 \leqq L/P \leqq 0.55$ with respect to a twisting pitch P and a preforming height H of $1.05 \leqq H/d \leqq 2.0$ with respect to the base wire diameter d.

The steel cord of the present invention is produced by using an apparatus provided with revolving preformers on the wire introducing portion of a bunching machine in such a manner that the bunching machine is rotated in a direction reverse to the rotational direction of the revolving preformers to thereby helically preform each of base wires and then the preformed wires are twisted by the bunching machine.

Further, in order to achieve the second object of the present invention, there is provided a radial tire which is at least partially reinforced with a high elongation steel cord having the above-described structure.

The portion of the radial tire which is reinforced by the above-described steel cord is the belts, more preferably, the belt that lies near the tread of the tire.

To describe the advantages and features of the present invention, since the rate of elongation at break of the steel cord according to the present invention is not less than 5%, the tire reinforced with it has a favorable anti-cutting property.

Moreover, the base wires are helically preformed to a shape different from a helical shape to which the cord may be twisted. Accordingly, while the cord is produced by twisting the base wires at a long twisting pitch in the same direction by one twisting operation, gaps are formed among the wires so that rubber penetrates into the central portion of the cord to thereby prevent the separation of the cord from the rubber.

Further, since the twisting pitch of the cord is long, high productivity can be expected and since the spinning loss is small, the rate of utilization can be increased. Moreover, since the twisting pitch is long and twisting is performed by one operation, the manufacturing cost can be reduced.

Further, the steel cord of the present invention is formed of helically preformed base wires keeping gaps thereamong so that the cord has a compact form. Therefore, the base wires are stabilized and become hardly biased at the time of topping process. Moreover, it hardly becomes birdcage-like due to the axial compressive force and so no excessively large space is formed within the cord so that even when the tire has a wound penetrating through the tread, no foreign matter can penetrate through the cord with ease.

Further, since the cord of the present invention has its elongation under a load of 35 kg f/mm$^2$ in the range of 0.71–1.00% and its elongation under a load of 70 kg f/mm$^2$ in the range of 1.18–1.57%, the rigidity and elongation can be well-balanced when the cord is used for the belts and a sense of comfortable ride and controllability of the tire can be improved.

Furthermore, the base wire preforming conditions are so set that the preforming pitch L satisfies the formula of $0.25 \leqq L/P \leqq 0.55$ and the preforming height H satisfies the formula of $1.05 \leqq H/d \leqq 2$ with respect to the base wire diameter d, so that a favorable degree of elongation of the cord can be realized without reducing the strength of the cord.

Still further, since the base wires are so twisted that the ratio P/D of the cord diameter D with respect to the cord twisting pitch P is in the range of 8–15, it is possible to realize an elongation at break of not less than 5% without reducing the spinning loss.

DESCRIPTION OF PREFERRED EMBODIMENTS

Figure 1:
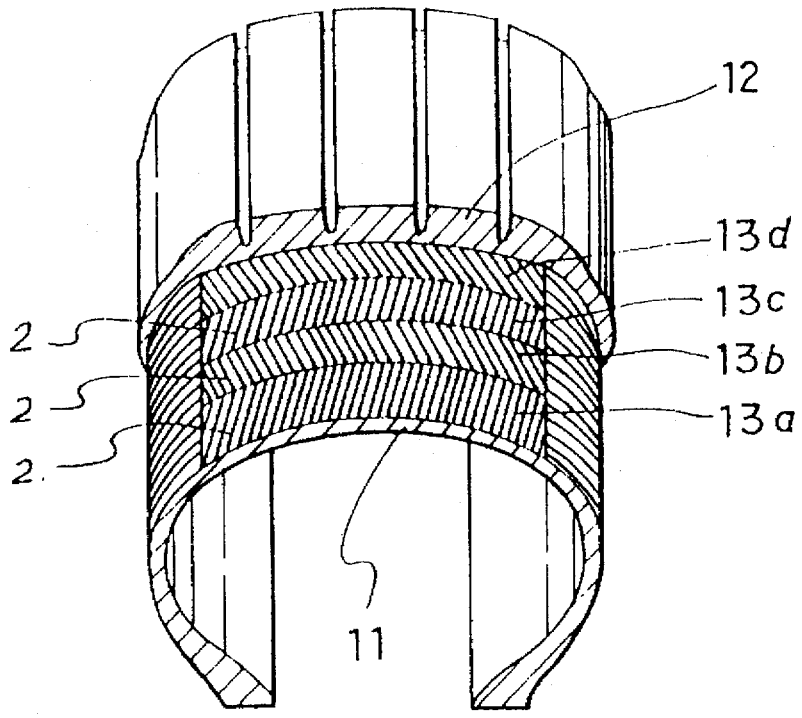
FIG. 1 is a front view (partially cut away) of a radial tire using a steel cord according to the present invention.
Figure 2:
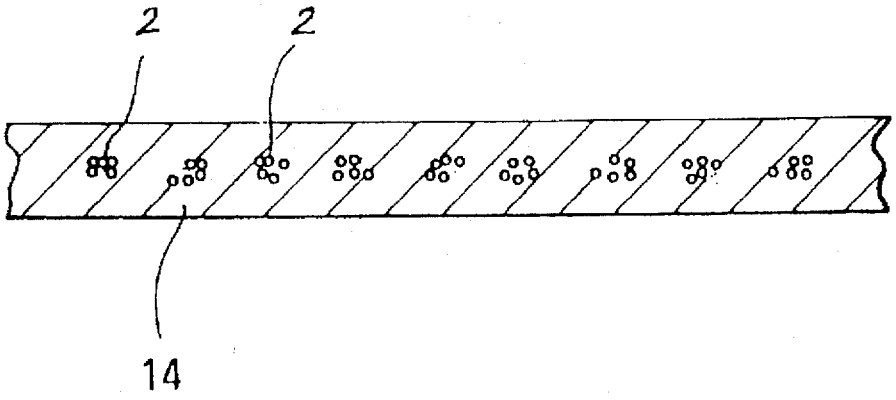
FIG. 2 is a partial section view of a fourth belt of the radial tire of the present invention.

FIG. 1 shows a radial tire according to the present invention wherein reference numeral 11 designates a carcass, reference numeral 12 designates a tread, reference numerals 13*a*, 13*b*, 13*c* and 13*d* designate a plurality of belts (a total of four in this case) disposed between the carcass 11 and the tread 12.

The belts 13*a*, 13*b*, 13*c* and 13*d* are produced in such a manner that the parallelly arranged steel cords 2 are topped with rubber from on both sides thereof to provide a rubber layer 14 and then the rubber layer 14 is vulcanized after shaping a tire.

The rubber may be natural or synthetic but it is not preferable from the point of view of separation and durability of the cord that 50% modules be in the order of 10–40 kg/cm$^2$.

The characteristics of the present invention reside in the above-mentioned steel cord 2 and the fact that the steel cord 2 is embedded in the belt, especially the belt 13 located nearest the tread 12.

Figure 3:
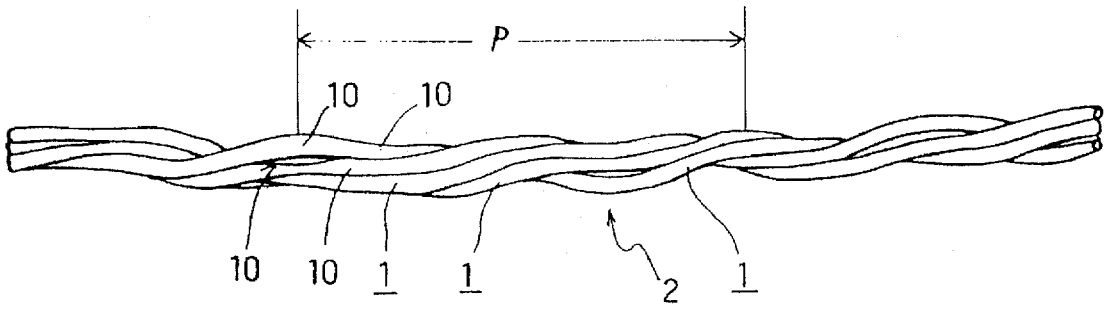
FIG. 3 is an enlarged side view of one example of a steel cord of the present invention.
Figure 4:
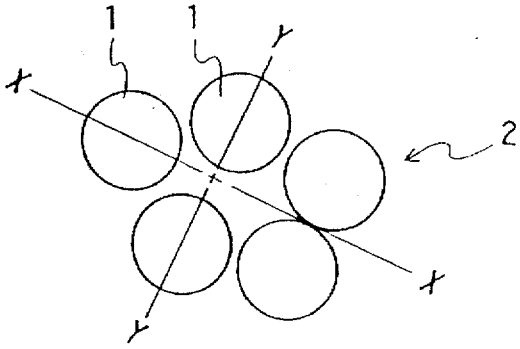
FIG. 4 is an enlarged sectional view of the steel cord shown in FIG. 3.

FIGS. 3 and 4 show a high elongation steel cord of 1×5 structure according to the present invention which is in the shape of a disruptive pentagon in section.

Basic wires 1, 1 forming the cord are arranged such that at least a set of adjoining wires are in contact with each other and at least one such sectional configuration appears every pitch of cord.

Figure 5:
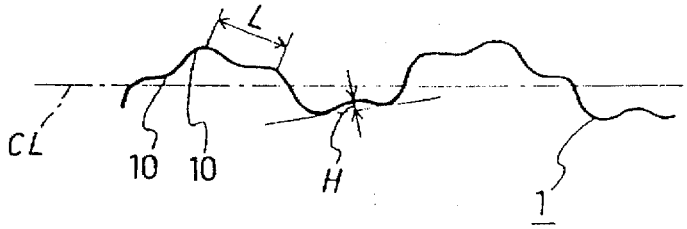
FIG. 5 is a partial side view of a basic wire taken out from the cord shown in FIG. 3.

Each of the wires 1 consists of a steel wire of a diameter of 0.15–0.45 mm which surface is plated with brass or zing as in the case of the known one. Before being twisted into a cord, the basic wires 1 are so preformed that they are undulated continuously and repeatedly with a predetermined pitch and a height. In this condition, the basic wires 1, 1 are twisted at a predetermined twisting pitch P larger than the above-mentioned performing pitch and in the same direction by one operation. FIG. 5 shows a waveform of one of the basic wires 1 obtained from a twisted cord wherein reference numeral 10 designates a wave.

To describe in more detail the steel cord 2 of the present invention, it is essential for the steel cord to have a high elongation characteristic of not less than 5% at break because this requirement is indispensable to improve the anti-cutting property of a tire.

The present invention aims at realizing an elongation at break of not less than 5% by one twisting operation and without shortening the cord twisting pitch and at the same time, aims at improving the penetrability of rubber.

Therefore, according to the present invention, the basic wires 1 are helically preformed and then the helically preformed wires 1 to become helically shaped differently from the helical preform whereby the spun or twisted basic wires 1 is made to have a composite helical shape with the result that the basic wires are twisted at a rate higher than the design twisting rate.

If the preforming pitch L for each basic wire 1 is short, the rate of elongation of the wire is high while the break load reduces. Likewise, the shorter the cord twisting pitch P, the higher the rate of elongation of the cord but the break load becomes low due to a twisting loss. Therefore, in the case of the present invention, the wire preforming pitch L and the cord twisting pitch P are made to fall under a predetermined optimum range.

First, it is preferable that the wire preforming pitch L be smaller than the cord twisting pitch P, i.e., in a range satisfying the formula of $0.25 \leqq L/P \leqq 0.55$.

The reasons for the above is that although it is effective for improving the rate of elongation of the wire to make the preforming pitch L small to satisfy the formula of $0.25 \geqq L/P$, the shape of the cord becomes irregular and no uniform load is applied on each of the wires forming the cord resulting in reducing the cord cutting load. On the contrary, if the preforming pitch L is so large as to satisfy the formula $L/P \leqq 0.55$, the wires are twisted at a rate higher than the design twisting rate with a shortage of length of each wire so that the rate of elongation of the cord unsuitably lowers.

It is preferable that the wire preforming height H with respect to the wire diameter d satisfy the formula of $1.05 \leqq H/d \leqq 2.0$. The reason forthis is that if the value of H/d is smaller than 1.05, the rate of elongation of the wire becomes insufficient while if the value of H/d is larger than 2.0, no uniform load is applied on the wire resulting in an insufficient rate of elongation of the wire.

On the other hand, the cord twisting pitch P is expressed by the ratio (P/D) with respect to the cord outer diameter D.

In this case, [the cord outer diameter D] is calculated by averaging the measured values of the outer diameter of the cord both in X—X direction and Y—Y direction of FIG. 4 at five points per pitch and the value of P/D according to the present invention is in the range of 8–18 and preferably in the range of 10–14.

When the Value of P/D is less than 8, the productivity of the cord is still at low level and the spinning loss is also great so that the strength of the base wires can not be made use of effectively and since twisting becomes irregular, the value is not proper. To make the value P/D larger than 15 is effective in points of cord productivity and twisting loss but it is not possible with such value to achieve an elongation at break of not less than 5% and therefore, this value is not suitable.

By setting the preforming pitch L to a value in the range of $0.25 \leqq L/P \leqq 0.55$ and by setting the cord twisting pitch to a value in the range of P/D=10–14, it is possible to keep the elongation characteristic, productivity and rubber penetrability of the cord in a balanced state.

Further, in the case of the steel cord 2 of the present invention, in addition to the setting of the elongation at break of the cord to a value not less than 5%, the elongation under a load of 35 $kgf/mm^2$ is set to a value in the range of 0.71–1.00% and that under a load of 70 $kgf/mm^2$ is set to a value in the range of 1.18–1.57%.

The reason for the above is that mere setting of the value for the elongation at break of the cord can not ensure the realization of a suitable elongation characteristic when the cord is actually used in the belt of a tire so that the value lacks practicality.

The elongation under a load of 35 kgf means an elongation under a load of one-sixth (⅙) of a cutting load. If an elongation under a load of 35 kgf is smaller than 0.71%, the cord does not favorably follow the movement of rubber and is therefore not desirable because no comfortable ride can be expected. However, if the elongation under a load of 35 $kgf/mm^2$ is set to a value so large as to exceed 1.0%, the cord lacks rigidity to become too soft that the controllability of driving becomes bad.

The elongation under a load of 70 $kgf/mm^2$ means the elongation under a load equal to one-third (⅓) of the cutting load and in this case, too, if the elongation is smaller than 1.18%, the comfortableness of riding lowers while when it is larger than 1.57%, the controllability lowers. Therefore, so long as the elongation of the cord remains in the above range, the anti-cutting property of the cord is favorable and the comfortableness of riding and controllability of driving with respect to the tire are improved thereby realizing an ideal cord elongation characteristic.

Accordingly, while the steel cord of the present invention has a one-operation type high elongation steel cord having an elongation at break of not less than 5%, it has a long twisting pitch and since a high degree of elongation is obtained by one spinning operation, the twisting loss is small so that the strength of the base wires can be effectively made use of.

Further, in the case of the present in the case of the present invention, a plurality of base wires which are helically preformed at a pitch are simultaneously twisted at a long twisting pitch so that the resultant cord is made to have a composite helical shape as whole which is different from that of each of the base wires formed by preforming. Consequently, while the cord is of compact type, gaps leading to the central portion of the cord are formed here and there and accordingly, it has a good rubber penetrability and excellent anti-corrosion fatigue property.

Accordingly, even if a radial tire using the steel cords of the present invention is externally injured, no foreign matter penetrates into the tire so that the tire has a favorable anti-cutting property and at the same time, can effectively prevent the separation of belts from the cords and further, since the rigidity and elongation of the cord are well balanced, the tire can have good comfortableness of riding, controllability and durability.

The present invention is always not limited to the above-mentioned (1×5) structure cord. That is, it may cover (1×3), (1×4) and (1×6) structure cords. Further, any the cords of the above structure around the outer periphery of which a piece of base wire having the same diameter of a suitably small thickiness is helically lapped may also be covered by the present invention.

Further, structures of (1×7), (1×8), (1×9), (1×10), (1×11) and (1×12) may also be employed. However, the number of base wires forming a cord is 7 or more, the cord has a core therein so that in many cases, a favorably elongation characteristic can not be obtained. Therefore, the number of base wires is six (6) or less, that is, (1×3)–(1×6) structures.

Figure 6:
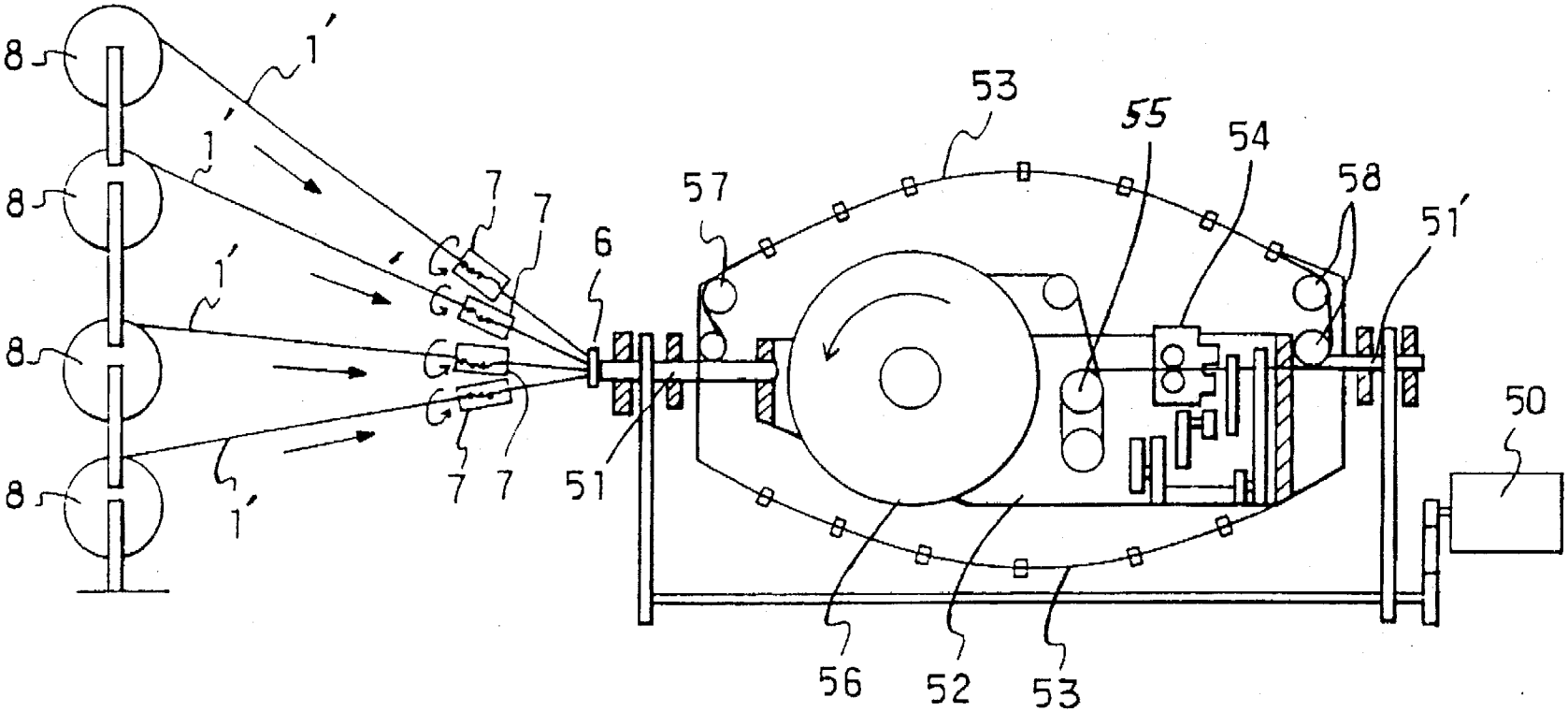
FIG. 6 is an illustration of a steel cord manufacturing apparatus according to the present invention.
Figure 7:
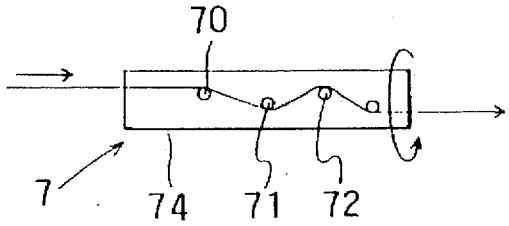
FIG. 7 is a plan view of a revolving preformer attached to the apparatus shown in FIG. 6.

The steel cord 2 according to the present invention is manufactured by a single process by using a double twist buncher type twister schematically shown in FIGS. 6 and 7.

The buncher type twister 5 comprises a main body (cradle) 52, hllow shafts 51 and 51' driven by a primer mover 50 and bows 53 mounted on the main body 52 so as to rotate integrally with the hollow shafts 51 and 51'. The main body 52 is provided with a takeup bobbin 56, a capstan 55 located upstream side with respect to the takeup bobbin 56 and an over twister 54 located further upstream side. The inlet side hollow shaft 51 is provided with a die 6 and there are arranged a plurality of revolving preformers 7 on the upstream side with respect to the die 6.

Each of the revolving preformers 7 comprises a platelike or tubular rotary member 74 attached with 3–4 pins 70, 71 and 72. On the upstream side of the revolving preformers 7 there provided a plurality of supply bobbins 8 from which base wires 1 are introduced and then collected into the die 6 through the pins 70, 71 and 72 of the preformers 7.

It should be noted that the twisted base wires from the twister should be actively guided to the revolving preformers 7 without installing rolls for fixing the twists of the base wires before and after each of the revolving preformers 7.

The motive power from the buncher type twister 5 is transmitted to the above-mentioned rotary members 74 are revolved simultaneously by being associated with one another through gears. This revolution is so adjusted as to be made in a direction reverse to the direction of rotation of the blows 53 and at a predetermined speed ratio.

Accordingly, when manufacturing a cord, the base wires 1 from the supply bobbins 8 are introduced to the die 6 through the revolving preformers 7. Then the basic wires 1 are passed through the hollow shaft 51, passed around the guide rolls 57 to be carried by the bows 53, guided to the over twister 54 by the guide rolls 58 through the hollow shaft 51' so as to be twisted into a cord and the cord is wound around the takeup bobbin 56 through the capstan 55.

In the above state, the hollow shafts 51 and 51' are driven to rotate the bows 53 and at the same time, the revolving preformers 7 are rotated at a required speed ratio with respect to the rotation of the bows 53. By so doing, the basic wires 1 are preformed to be continuously undulated as they pass the pisn 70, 71 and 72. Moreover, as the revolving preformers 7 themselves rotate about the base wire passing lines, respectively, the base wires become helical and are continuously fed into the die 6 in that condition so as to be bundled.

In the above state, the base wires 1 are introduced into the hollow shaft 51 and in the course from the hollow shaft 51 up to the guide rolls 57, the base wires 1 are subjected to a first twisting operation. Further, in the course from the guide rolls 58 up to the hollow shaft 51', the base wires sare subjected to a second twisting operation to make themselves a steel cord 2 and as the cord passes through the over twister 54, the twisting state is adjusted to be wound around the takeup bobbin 56.

The pitch of each of the first and second twisting operations is larger than the preforming pitch by each of the revolving preformers 7 and moreover, the twisting pitch is as long as more than ten times the diameter of the cord. Accordingly, it is possible to produce the steel cord 2 efficiently as illustrated in FIGS. 3 and 4.

Where the revolving preformers 7 and the bows 53 rotate in the same direction, the preforming pitch would become substantially long. On the contrary, if the revolving preformers 7 and the bows 53 are rotated in opposite directions, the actual preforming pitch L would become short as expressed by the reciprocal of a total of the reciprocal of the preforming ptich Lo by the revolving preformer and the reciprocal of the cord twisting pitch P, i.e., [Lo×P/(Lo×P)].

The embodiments of the present invention will now be described.

1) First, a steel cord was produced according to the present invention and the results of characteristic tests conducted on the steel cord are shown in the Table 1 together With those of tests conducted on comparison examples 1–7 and a conventional example.

The produced steel cord was of a (1×5) structure with the diameter of each of base wires forming the cord bgeing 0.35 mm and produced by a manufacturing apparatus shown in FIGS. 6 and 7. The number of revolutions of the rotary member was 2500 rpm and the revolving preformer used was of tubular three pin type. Further, the conventional cord was produced by removing the preformers.

Figure 8:
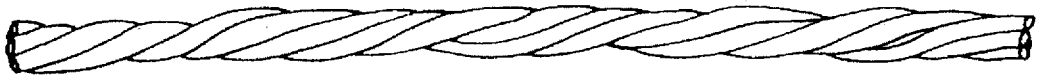
FIG. 8 is an enlarged side view of a steel cord given as a comparison example.
Figure 9:
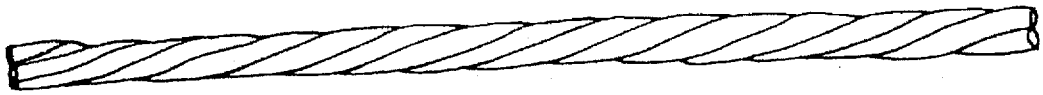
FIG. 9 is a side view of a conventional steel cord.

The shape of the cord of the comparis example 1 is shown in FIG. 8 and the shape of the cord of the conventional example is shown in FIG. 9. The figures given in the preforming pitch and height columns of Table 1 are values actually measured after disjoining the base wires forming the cord. In the comparison examples 1 and 2, the reason why the preforming pitch P and height H are shown unmeasurable is that the values for P and H could not be measured by a projector because the preforming pitch height is small.

Of the characteristic tests, the test regarding [elongation at break] was conducted in accordance with ASTM and the test regarding [rubber penetrability] was conducted in such a manner that each target steel cord was divided into two parts being vulcanuized under a tensile force of 100 g, the surface of the wires forming the steel cord were visually observed and the area of the rubber covering was expressed in terms of percentage.

Further, the test regarding [Bending Strenght] was conducted in such a manner that each sample cord of a length of 70 mm was applied with a predetermined bending force and the magnitude of moment required therefor was measured and compared with a covnentional produced which was set to a value of 100.

The test regarding [Durability] was conducted by using a beltlike test body obtained as a result of embedding a cord sample in a rubber material same as that which was used for a tire belt and then vulcanizing the rubber material. In this case, the test body was repeatedly subject to bending steps by a testing machine comprising three rolls each having a diameter of 33 mmϕ and the number of bending steps applied onto the test body until the embedded cord sample breaks was measured. The measured value was then compared to the value of the conventional produced which was set to 100.

As will be clear from Table 1, according to the first and second aspects of the present invention, since the relationships between the preforming pitch and height of each of base wires forming a cord and the twisting pitch of the cord are appropriate, the cutting load of the cord is high in spite of the largeness of elongation of break thereof. Further, the elongation under a load of 35 kg f/mm$^2$ and that under a load of 70 kg f/mm$^2$ are also favorable. Further, since gaps leading to the central portion of the cord are formed among the base wires at a pitch shorter than the twisting pitch of the cord, the penetrability of rubber is favorable.

The comparison example 1 fails to have sufficient characteristics because of its short twisting pitch and its productivity is also not good. The comparison example 2 has no good productivity because of the smallness of P/D and the characteristics thereof are not sufficient. The comparison example 3 can not give a sufficient degree of elongation due to the largeness of P/D. The comparison example 4 has a low degree of cutting load due to the smallness of LIP. The comparison example 5 has insufficient elongation and rubber penetrability due to the largeness of L/P. The comparison example 6 has no sufficient elongation because its H/d deviates toward the lowest limit and the comparison example 7 has an insufficient degree of elongation because its H/d somewhat deviates toward the highest limit so that it can not retain its shape as a twisted cord.

The conventional example clears the condition of elongation at break but the rubber penetrability thereof is not good and the elongation under a load of 35 kg f/mm$^2$ and that under a load of 70 kg f/mm$^2$ are also not good. Further, the productivity thereof is also bad.

Figure 10:
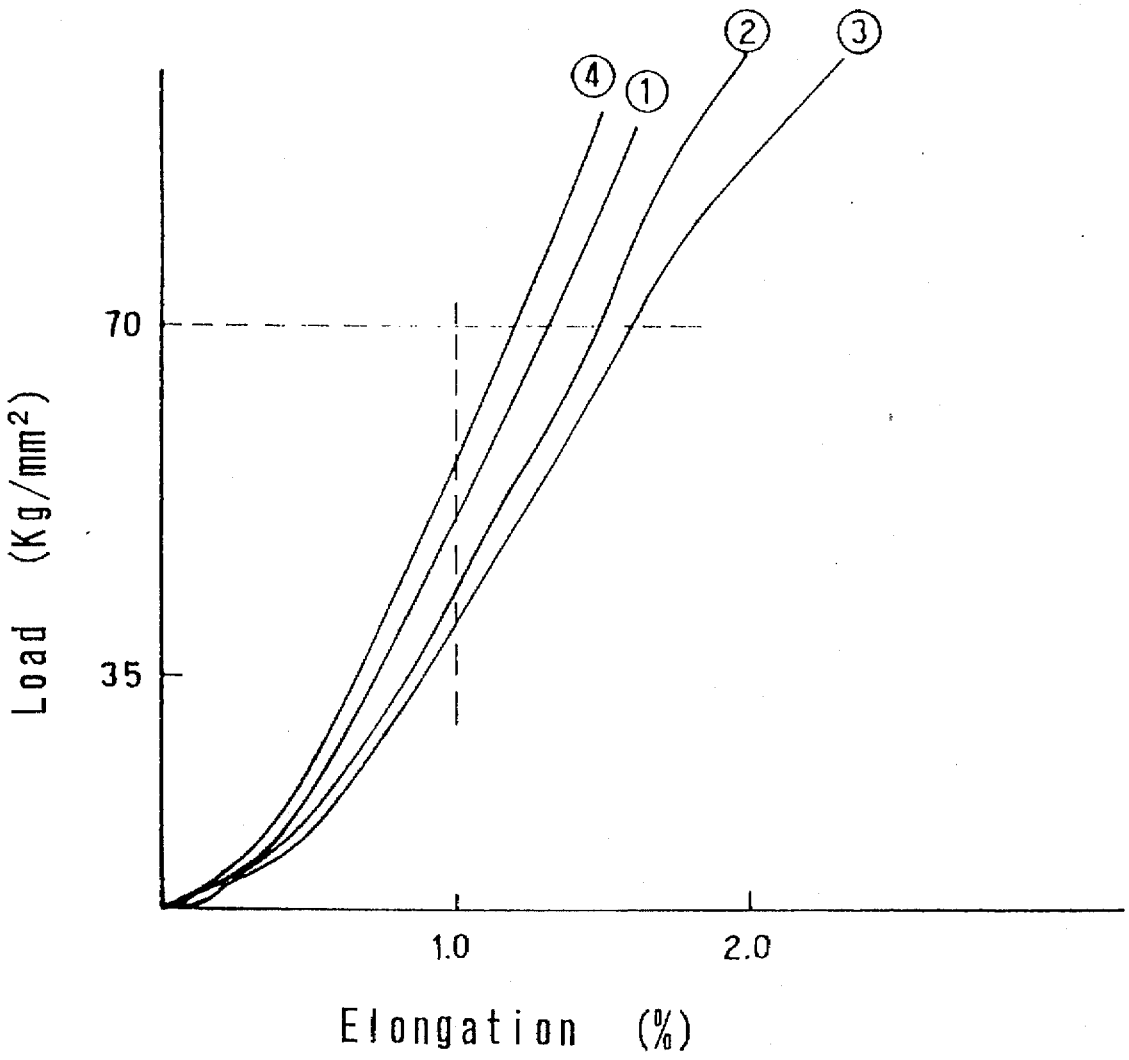
FIG. 10 is a graph showing cutting load/elongation relationships among steel cords of the present invention, the conventional steel cord and the comparison steel cord.

FIG. 10 shows the cutting load-elongation relationships between the products (2) & (3) of the present invention and the comparison examples 1 (1) and the conventional example (4). It will be seen from this figure that each of the products (2) & (3) of the present invention doesn ot show any abrupt change in its elongation with respect to the tensile load but shows a smooth and large degree of elongation.

(2) Next, the cord products (2) & (3) according to the present invention were used for reinforcing the fourth belt closest to the tire tread of FIG. 1 to thereby produce a 100R20 radial tire.

A rubber material was mixed according to the following proportion (parts by weight) and the mixture was vulcanized under the condition of 150° C.×25 min.

Natural rubber: 100, HAF:50, Stearic acid: 1, ZnO: 5, 3C: 3 and Sulfur: 2

Vulcanization accelerator: 1.5 Antioxidant: 0.5

The thickness of each belt was 2.1 mm, the intercord space was 2.2 mm and the cord angle was 20 degrees.

Further, the first belt includes a (3+6) structure cord rising up toward the right at an angle of 65 degrees, the second belt includes a (3+6) structure cord rising up toward the left at an angle of 20 degrees and the third belt includes a (3+6) structure rising up toward the right at an angle of 20 degrees. The carcass was formed of thirteen (13) ordinary steel cords (3+9+15×0.175+1) arranged with a density of 13/2.54 cm and at an angle of 90 degrees.

The above-described radial tire (according to the present invention) was subjected to a drum test of a velocity of 40 km/h in which the tire was applied with an internal pressure of 7.5 kg/cm$^2$ and JIS standard load.

For comparison purposes, travelling tests were also conducted on a radial tire (comparison tire 1) embedded with the conventional cord product in its belts under the above-described conditions, a radial tire (comparison tire 2) embedded with the comparison example cord 4 in its belts under the above-described conditions and a radial tire (comparison tire 3) embedded with the comparison example cord 6) in its belts under the above-described conditions.

In the above tests, each of the tires was disassembled when a travelling time corresponding to a travelling distance of 25000 km was reached and the breakage of the steel cords in each of the belt layers and the separation of the cord edges from the belts were inspected. As a result, it was found that no breakage of the steel cords and no separation of the cord edges from the belts were observed with respect to the radial tire of the present invention. On the contrary, it was also found that there were a 20% cord breakage and a 15% cord edge separation with respect to the comparison tire 1, a 15% cord breakage and a 10% cord separation with respect to the comparison tire 2 and a 25% cord breakage and a 20% cord edge separation with respect to the comparison tire 3.

From the above results, it will be apparent that the radial tire according to the present invention has a favorable fatigue-resistance property as the embedded cords follow the expansion and a contraction of the belt rubber while any of the comparison tires 1 and 3 has the disadvantage that there is the possibility of breakage of the belt layers and such breakage tends to develop.

What is claimed is:

1. A steel cord of a (1×n) structure, comprising at least three base wires helically preformed at a pitch shorter than a cord twisting pitch, said base wires being twisted in a same direction and at the same pitch by one twisting operation with an elongation at break of not less than 5% so that a ratio P/D of a cord outer diameter D with respect to a twisting pitch P is in the range of 8–15 and as a result said base wires make a helical composite structure due to said twist and said helical preforming, and an elongation of the steel cord under a load of 35 kgf/mm$^2$ is in the range of 0.71–1.00% and an elongation of the steel cord under a load of 70 kgf/mm$^2$ is in the range of 1.18–1.57%.

2. A steel cord as defined in claim 1, wherein each of said preformed base wires has a preforming pitch L satisfying the formula of $0.25 \leqq L/P \leqq 0.55$ and a preforming height H satisfying the formula of $1.05 \leqq H/d \leqq 2.0$ in relation to a diameter d of each of the base wires.

3. A steel cord as defined in claim 1, wherein the number of said base wires is in the range of 3–6, and the diameter of each of said base wires is in the range of 0.15–0.45 mm.

4. A steel cord as defined in claim 1, wherein at least two of the adjacent base wires of said base wires are in contact with each other in a section taken perpendicular to the longitudinal direction of the cord, and this occurs at least once every one pitch of the cord.

5. A radial tire a portion of which is reinforced with steel cord of a (1×n) structure including at least three base wires helically preformed at a pitch shorter than a cord twisting pitch, said base wires being twisted in a same direction and at the same pitch by one twisting operation with an elongation at break of not less than 5% so that a ratio P/D of a cord outer diameter D with respect to a twisting pitch P is in the range of 8–15 and as a result said base wires make a helical composite structure due to said twist and said helical performing, and an elongation of the steel cord under a load of 35 kgf/mm$^2$ is in the range of 0.71–1.00% and an elongation of the steel cord under a load of 70 kgf/mm$^2$ is in the range of 1.18–1.57%.

6. A radial tire as defined in claim 5, wherein each of said preformed base wires has a preforming pitch L satisfying the formula of $0.25 \leqq L/P \leqq 0.55$ and a preforming height H satisfying the formula of $1.05 \leqq H/d \leqq 2.0$ in relation to a diameter d of each of the base wires.

7. A radial tire as defined in claim 5, wherein the number of said base wires is in the range of 3–6, and the diameter of each of said base wires is in the range of 0.15–0.45 mm.

8. A radial tire as defined in claim 5, wherein said reinforced portion is a belt.

9. A radial tire as defined in claim 8, and further including a tread, wherein said belt is adjacent to said tread.

* * * * *